United States Patent [19]

Suzuki et al.

[11] Patent Number: 4,769,662

[45] Date of Patent: Sep. 6, 1988

[54] METHOD OF SUPPLYING REPLENISHING SOLUTION IN AUTOMATIC DEVELOPING MACHINE

[75] Inventors: Takafumi Suzuki; Yoichi Endo, both of Kanagawa, Japan

[73] Assignee: Fuji Photo Film Co., Ltd., Kanagawa, Japan

[21] Appl. No.: 36,532

[22] Filed: Apr. 9, 1987

[30] Foreign Application Priority Data

Apr. 9, 1986 [JP] Japan ..... 61-081919
Apr. 15, 1986 [JP] Japan ..... 61-086654
Jul. 4, 1986 [JP] Japan ..... 61-157518

[51] Int. Cl.[4] ..... G03D 3/02
[52] U.S. Cl. ..... 354/324; 354/321
[58] Field of Search ..... 354/298, 320, 321, 322, 354/324

[56] References Cited

U.S. PATENT DOCUMENTS 4,422,152 12/1983 Kaufmann ..... 354/298
4,480,901 11/1984 Osegowitsch et al. ..... 354/324
4,486,082 12/1984 Wagner et al. ..... 354/298

FOREIGN PATENT DOCUMENTS 61-275757 12/1986 Japan .

*Primary Examiner*—A. A. Mathews
*Attorney, Agent, or Firm*—Sughrue, Mion, Zinn, Macpeak & Seas

[57] ABSTRACT

Disclosed is a method of supplying replenishing solution in an automatic developing machine which processes exposed film by means of pump. A time required for the pump to operate is determined using a discharge rate of the pump and a total quantity of replenishing solution to be supplied which is determined in accordance with the amount of exposed film to be processed, and the pump is continuously operated accordingly in that operating time. In consequence, a small size pump can be employed, and the variations in pump discharge rate can be compensated for by controlling the operating time of the pump.

18 Claims, 10 Drawing Sheets

(A)

(B)

(A)

(B)

METHOD OF SUPPLYING REPLENISHING SOLUTION IN AUTOMATIC DEVELOPING MACHINE

BACKGROUND OF THE INVENTION

The present invention relates to a method of supplying replenishing solution in an automatic developing machine, and more particularly, to a method of supplying replenishing solution which is utilized in an automatic developing machine that automatically performs development, fixing, washing and drying of exposed film, and which allows replenishing solution such as a replenishing solution for developer or a replenishing solution for fixing solution to be automatically supplied to a processing tank.

DESCRIPTION OF THE RELATED ART

Automatic developing machines which automatically perform development, fixing, washing and drying of exposed film have a device for supplying a replenishing solution for developer or a replenishing solution for fixing solution. Components in such replenishing solutions may be the same as those in processing solutions in the processing tanks. Such replenishing solution supplying devices are equipped with any of various types of pump for supplying a processing tank with the replenishing solution, including a bellows type pump, a magnet pump, and a vibration pump. The bellows type pump is constructed such that the rotation of a motor is converted to a linear motion by a crank mechanism so as to expand and contract the bellows and thereby discharging the replenishing solution from the pump. Conventionally, a given amount of replenishing solution is supplied to the processing tank by intermittently operating a large size bellows type pump which discharges a large quantity of replenishing solution per expansion/-contraction cycle of the bellows. The large size pump discharges a large quantity of replenishing solution each time the bellows expands and contracts. The quantity of replenishing solution to be supplied is first determined on the basis of the amount of film to be processed over a predetermined period of time. The pump then operates to supply the replenishing solution in an amount which corresponds to the determined quantity. Thereafter the pump operation is stopped for a predetermined period of time, and this cycle of operation is then repeated In this way excess supply of replenishing solution is avoided. Alternatively, a replenishing pump is driven intermittently by a drive motor having a power which is large enough to ensure that the pump discharges a sufficiently large quantity of solution.

In a case wherein the replenishing solution is supplied to the processing tank in an amount determined in the manner described above by employing a large size bellows type pump, if it is determined that the pump is operated for a short period of time, the bellows may stop midway through a cycle of expansion and contraction, with the result that the required amount of replenishing solution cannot be supplied to the processing tank. Further, in order to quickly supply a predetermined amount of replenishing solution to the processing tank, a large size pump is employed, or alternatively a sufficiently high discharge rate is given to the pump, raising the production cost of the device. The discharge rate of the bellows pump may have variability due to errors generated during production, or in the case of the use of a bellows pump employing a synchronous motor, the discharge rate of the pump may vary due to the different power source frequency. These variations in the quantity of replenishing solution discharged are conventionally compensated for by adjusting the length of the crank of the crank mechanism connecting the bellows pump with the motor. However, the operations of modifying the length of the crank and mounting the crank are troublesome and time consuming.

The discharge rate of the magnet pump also experiences variability in the discharge rate due to the production errors as in the case of bellows pump, and this variance in discharge rate is compensated for by changing the frequency of driving pulses or by changing the stroke length of a plunger.

Further, the discharge rate of the pump varies due to the difference in frequency (between 50 Hz and 60 Hz, for example) or voltage (between 100 V and 110 V, for example) of the power source employed for the motor which drives the pump. When manufactureing the pump, therefore, it is necessary to take into consideration the frequency or voltage of the power supplied in the local area at which the pump is installed.

Accordingly, an object of the present invention is to provide a method of supplying replenishing solution in an automatic developing machine which is capable of supplying the replenishing solution continuously by employing a small size pump.

Another object of the present invention is to provide a method of supplying replenishing solution in an automatic developing machine which is capable of adjusting variability in the discharge rate by controlling the operating time of a pump without adjustment of the crank length of a crank mechanism connecting a bellows pump with a motor or the stroke length of a magnet pump.

SUMMARY OF THE INVENTION

In order to obviate the above noted disadvantage of the prior art, the present invention provides a method of supplying replenishing solution in an automatic developing machine which processes exposed film by means of a pump, which method comprises the steps of: determining a discharge rate of the pump; determining the total quantity of replenishing solution to be supplied on the basis of the amount of exposed film to be processed; determining an operating time required for the pump to operate using the discharge rate and the total quantity of replenishing solution; and continuously operating the pump for the thus determined operating time.

In order to obtain the discharge rate of the pump, the pump is operated for a given period of time, and the quantity of solution discharged may then be measured with a measuring cylinder. The total quantity of replenishing solution to be supplied may be obtained by utilizing the area of the exposed film.

According to the present invention, the operating time of the pump is determined by utilizing the discharge rate of the pump, and it is therefore possible for variations in discharge rate to be compensated for.

Further, in the method of the present invention, since the quantity of the solution to be discharged is controlled by controlling the discharge time which is obtained using the discharge rate of the pump, it is not affected by the difference in frequency or voltage of the power supplied in the area of the installation of the pump.

Also, since the operation of the replenishing pump for supplying the replenishing solution is continuous, it is allowable to employ a small size pump which has a small discharge rate as the replenishing pump.

DETAILED DESCRIPTION OF THE INVENTION

Figure 1:
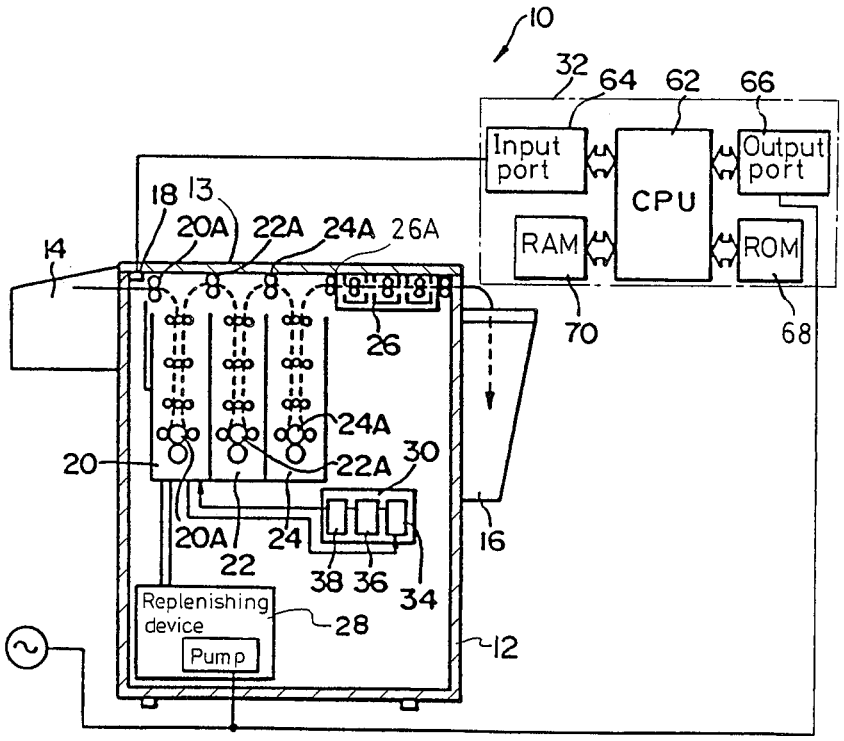
FIG. 1 is a schematic view of an automatic developing machine incorporating a first embodiment of the present invention.

Embodiments of the present invention will be described in detail with reference to the accompanying drawings. FIG. 1 shows an automatic developing machine 10 incorporating a replenishing solution supplying device for carrying out a first embodiment of the relenihsing solution supplying method according to the present invention.

The automatic developing machine 10 employed in this embodiment is of a type which is capable of developing, fixing, washing and drying exposed film.

The automatic developing machine 10 has a casing 12 which may have a cover 13 for shielding the external light. The front upper side of the casing 12 is provided with a table 14 through which exposed film is inserted, while the upper rear side thereof is provided with a film stocker 16 for storing developed film. A sensor 18 for detecting passing film is mounted on the casing 12 in the vicinity of the inserting table 14. The sensor 18 comprises a plurality of light emitting elements and a plurality of opposing light detecting elements which are arranged in the crosswise direction of the film near the film inserting table, and each light detecting element is switched on and off depending on the width of the film inserted. The sensor 18 may also be of a type in which the light detecting elements are switched on and off when it detects the light emitted from the light emitting elements and reflected by the inserted film.

The casing 12 accommodates a developing tank 20, a fixing tank 22, a washing tank 24 and a drying section 26 which are disposed in that order from the front side thereof. The automatic developing machine 10 incorporates a replenishing device 28, a circulating device 30, and a control section 32.

The developing tank 20, the fixing tank 22, the washing tank 24 and the drying section 26 which are disposed in the order in which a film is processed incorporate a plurality of guide rollers 20A, 22A, 24A, 26A for conveying the exposed film. The plurality of guide rollers 20A, 22A, 24A, 26A respectively form the passageway for the film, and the film is conveyed along this passageway by the rotation of the rollers.

The circulating device 30 accommodated in the casing 12 comprises a circulating pump 34, a processing solution filter 36, and a heat exchanger 38, as shown in FIG. 1. The developing tank 20 communicates with the circulating pump 34 via a piping 40, while the processing solution filter 36 communicates with the developing tank 20 via the heat exchanger 38, as shown in FIG. 3(A).

Figure 3:
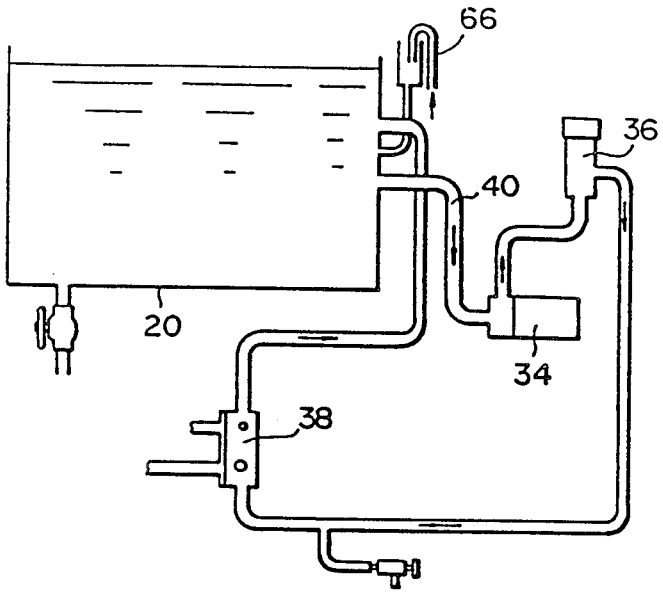
FIGS. 3A and 3B are diagrams of the piping of the automatic developing machine.
Figure 3:
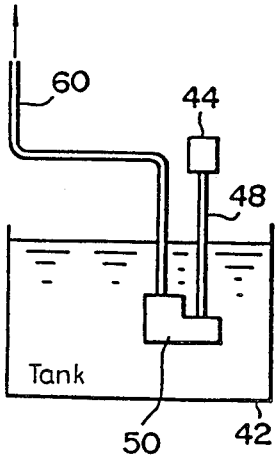
Figure 4:
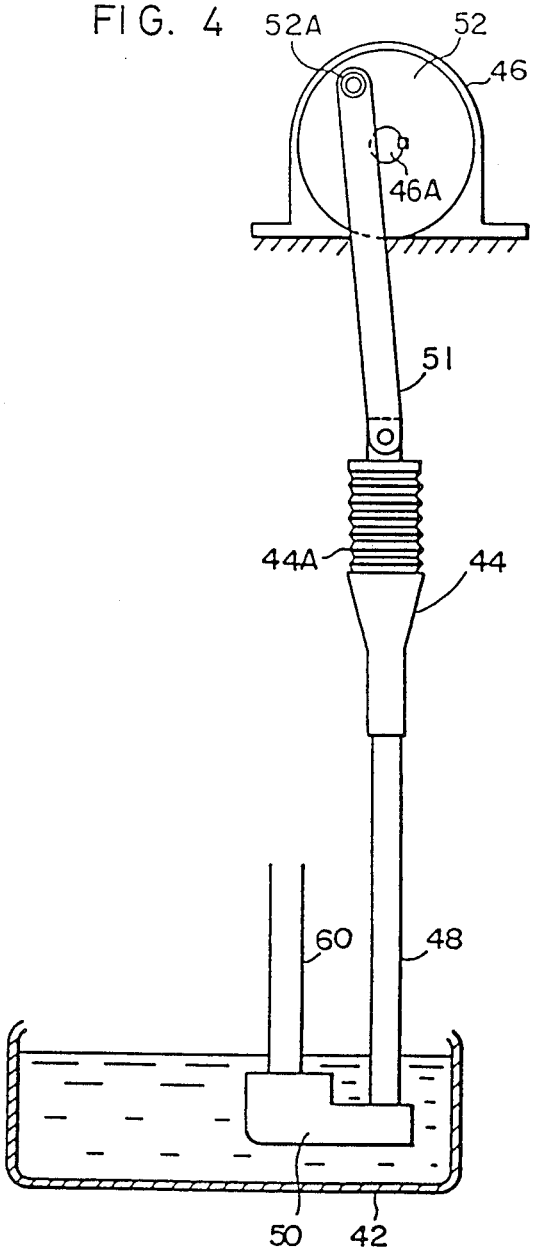
FIG. 4 is a schematic view of a bellows pump.

As shown in FIGS. 3(B) and 4, the replenishing device 28 comprises a replenishing tank 42 for containing the replenishing solution to be supplied, a bellows type pump 44, and a motor 46. The bellows type pump 44 includes expandable bellows 44A, a piping 48, and a section 50 for sucking in the replenishing solution 50. One end of the bellows 44A is linked with a coupling rod 51 constituting the crank mechanism, while the other end thereof is connected via the piping 48 to the replenishing solution suction section 50, the connecting section being immersed in the replenishing solution contained in the tank 42. The other end of the coupling rod 51 is rotatably supported on an eccentric shaft 52A fixed off-center on a rotating plate 52 mounted on an output shaft 46A of the motor 46.

The bellows type pump 44 is a small volume, small size pump which has a low discharge rate which is below the minimum quantity of replenishing solution determined in accordance with the amount of film to be processed.

Figure 5:
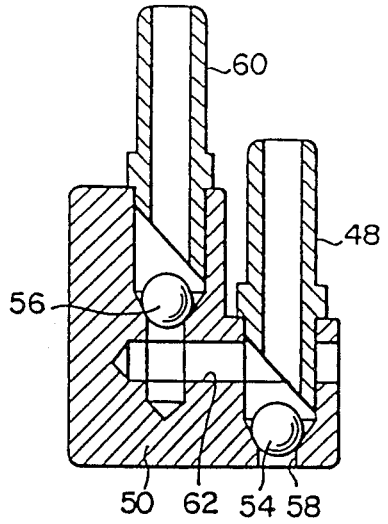
FIG. 5 is a cross-sectional view of a replenishing solution suction section of the pump.

As shown in FIG. 5, the replenishing solution suction section 50 immersed in the replenishing solution charged in the replenishing tank 42 accommodates ball-shaped check valves 54, 56 which open and close an inlet 58 and a piping 62 communicating the piping 48 and a piping 60, respectively.

The control section 32, as shown in FIG. 1, comprises a CPU 62, an input port 64, an output port 66, a ROM 68, and a RAM 70. The input port 64 is connected to the sensor 18.

The automatic developing machine of this embodiment will be operated in the following manner.

When the power source of the automatic developing machine 10 is switched on and the exposed film is inserted from the insert table, the film passing through the lower portion of the sensor 18 is detected, and the detection signal is input to the input port 64 of the control section 32.

After having passed through the lower portion of the sensor 18, the exposed film is guided to the bottom of the developing tank 20 along the film conveying passageway formed by the plurality of guide rollers 20A. The conveying direction of the film is then turned by the guide rollers 20A disposed at the bottom, and the film is conveyed to the upper portion of the developing tank. The exposed film thereby passes through the developer, and is developed by being passed through the developing tank 20. The developed film is further guided into the fixing tank 22 along the film conveying passageway formed by the plurality of guide rollers 22A disposed in the fixing tank 22, and is thereby fixed. The film fixed in the fixing tank 22 is guided to the washing tank along the film conveying passageway formed by the plurality of guide rollers 24A disposed in the washing tank 24, and is thereby washed with water. The washed film is then passed through the drying section 26 while being guided by the plurality of guide rollers 26A, so that it is dried and then stocked in the film stocker 16.

The developer contained in the developing tank 20 is circulated by the circulating pump 34. During circulation, the developer is cleaned by the filter 36, and the temperature thereof is adjusted by the heat exchanger 38 before being circulated to the developing tank 20.

Operation of the bellows type pump 44 and the motor 46 constituting the replenishing device 28 will be described below by referring to FIGS. 4 and 5.

When the output shaft 46A of the motor 46 rotates, the end of the coupling rod 51 constituting the crank mechanism which is connected to the bellows 44A is linearly moved in the vertical direction so as to expand and contract the bellows 44A. With the bellows 44A contracted, the replenishing solution charged in the interiors of the pump 44 and the piping 48 acts on the check valve 54 and thereby blocks the inlet 58. At the same time, the replenishing solution charged in the piping 62 pushes up the check valve 56 in the vertical direction, thereby discharging the replenishing solution from the piping 60. With expanded bellows 44A, the check valve 54 is sucked up in the vertical direction, and the replenishing solution thereby flows into the piping 48 through the inlet 58. By repeatedly expanding and contracting the bellows in the manner described above, the discharged replenishing solution is supplied to the developing tank 20 via the piping 60.

The control section 32 calculates the number of films and the size thereof on the basis of the signal which is input from the sensor 18, and a quantity Q required for replenishment based upon the number and the size of the films. It then calculates an operating time To of the pump.

Figure 2:
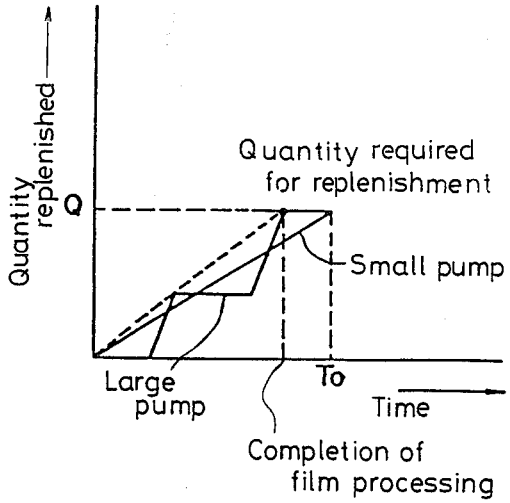
FIG. 2 is a graph showing the relation between time and the amount of replenishing solution discharged by a pump.
Figure 6:
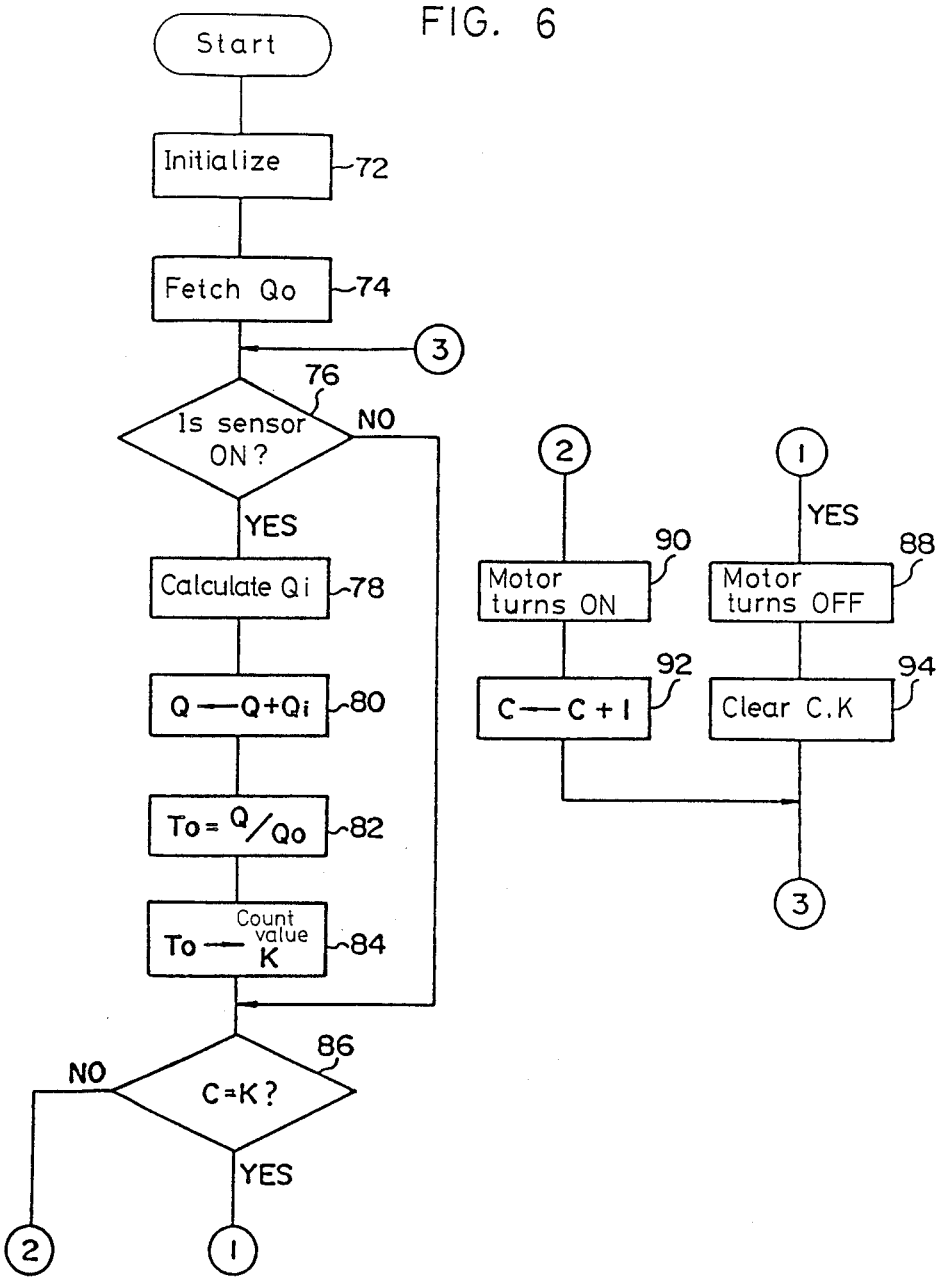
FIG. 6 is a flow chart of the pump control routine employed in the first embodiment of the invention.

FIG. 6 is a flow chart of the control routine of the CPU 62. When switched on, the CPU 62 initializes in Step 72. In Step 74, the CPU 62 fetches the discharge rate Qo of the pump which has been stored in the RAM 70 beforehand. In Step 76, a judgement is made as to whether the sensor is on or not, that is, the development of the film is started or not. If the answer is yes, the CPU 62 calculates the area of the film utilizing the number of switched sensor elements and the time over which they are on, as well as the quantity Qi of the replenishing solution required for replenishment in accordance with the obtained area in Step 78. In Step 80, the quantity Qi of the solution required for replenishment is sequentially added. The CPU 62 then calculates in Step 82 the operating time To of the pump using the discharge rate Qo of the pump which has been fetched in Step 74 and the quantity Q of the replenishing solution required for replenishment which has been determined in Step 78. In Step 84, the operating time To is replaced with the count value K. In Step 86, the CPU 62 compares the count value C by which the time over which the motor is on is counted with the count value K of the operating time To of the motor. If it is determined that the count value C is equal to the count value K, the motor is turned off in Step 88 so as to stop the replenishment. The count values C, K are then cleared in Step 94, and the program returns to Step 76. If it is determined that the count values C, K are not equal, the motor is turned on in Step 90 so as to supply the replenishing solution. In Step 92, the CPU counts the time over which the motor is on. The program then returns to the step 76 so as to repeat the processings. In other words, the CPU 62 calculates the area of the film and the quantity of the solution to be replenished, adds the quantity to be replenished sequentially, and stops the operation of the pump when the amount of the replenishing solution discharged by the pump becomes equal to the quantity added, so as to stop the replenishment of the solution. FIG. 2 shows the relation between the time required for replenishment and the quantity of the solution resplenished which is obtained by the above-described pump operation. While the replenishment is intermittent with the large size pump, the replenishing solution is continuously supplied in an amount which is below the quantity required for replenishment with the small size pump. However, the pump operation continues even after the film processing has been completed, and the pump is stopped when the quantity of replenishing solution discharged has become equal to the quantity of the replenishing solution required for replenishement. It is to be noted that the conventional large size pump has the discharge rate of 500 cc/min. to 800 cc/min. but the small size pump employed in the present invention has the discharge rate of 300 cc/min. or less, preferably 200 cc/min. or less. In the embodiment described above, the replenishing device supplied the developer. However, the present invention is also applicable to the replenishment of fixing solution.

Figure 7:
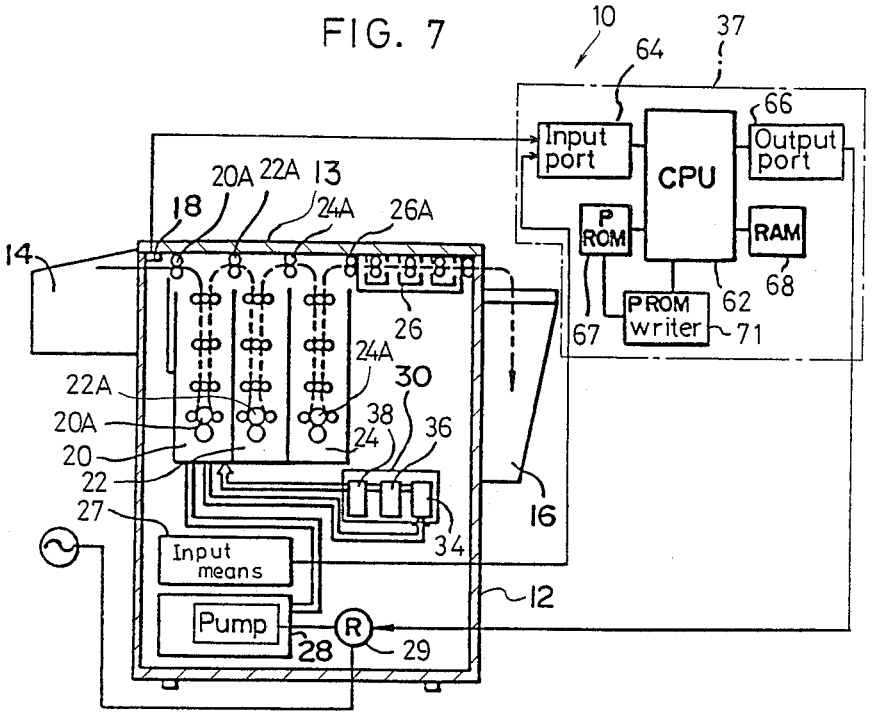
FIG. 7 is a schematic view of an automatic developing machine incorporating a second embodiment of the present invention.

A second embodiment of the present invention will be described below by referring to FIG. 7, in which the same reference numerals are used to denote the same parts or member as those of the first embodiment, their description being omitted.

The automatic developing machine 10 of this embodiment incorporates, in addition to the components of that of the first embodiment, an input means 27 and a relay 29. As will be described later, a control section 37 is also constructed in a slightly different manner from the first embodiment.

The replenishing device 28 is connected to the AC power source via the relay 29 connected to the control section 37.

The control section 37 comprises the CPU 62, the input port 64, the output port 66, a PROM 67, the RAM 60, and a PROM writer 71. The input port 64 is connected to the sensor 18 and the input means 27, while the output port 66 is connected to the relay 29.

The other components of this automatic developing machine 10 are the same as those of the automatic developing machine 10 of the first embodiment.

The automatic developing machine of this embodiment will be operated in the following manner.

When the automatic developing machine 10 is switched on and the exposed film is inserted from the insert table, the film passing through the lower portion of the sensor 18 is detected, and the detection signal is input to the input port 64 of the control section 37.

After having passed through the lower portion of the sensor 18, the exposed film is guided to the bottom of the developing tank 20 along the film conveying passageway formed by the plurality of guide rollers 20A. The conveying direction of the film is then reversed by the guide rollers 20A disposed at the bottom, and the film is conveyed to the upper portion of the developing tank. The exposed film thereby passes through the developer, and is developed by being passed through the developing tank 20. The developed film is further guided into the fixing tank 22 along the film conveying passageway formed by the plurality of guide rollers 22A disposed in the fixing tank 22, and is thereby fixed. The film fixed in the fixing tank 22 is guided to the washing tank along the film conveying passageway formed by the plurality of guide rollers 24A disposed in the washing tank 24, and is thereby washed with water. The washed film is then passed through the drying section 26 while being guided by the plurality of guide rollers 26A, so that it is dried and then stocked in the film stocker 16.

The developer contained in the developing tank 20 is circulated by the circulating pump 34. During circulation, the developer is cleaned by the filter 36, and the temperature thereof is adjusted by the heat exchanger 38 before being circulated to the developing tank 20.

The replenishing device 28 is arranged and operated in the same manner as in the first embodiment, and its description will be omitted.

In the control section 37, the number of films and the size thereof are operated on the basis of the signal input from the sensor 18 so as to determine the amount of film to be processed. The quantity of solution required for replenishment is then operated thereby. The quantity of replenishing solution discharged by the pump when it is operated in a given period of time is measured with measuring cylinder, and the result is input to the input port 64 of the control section 37 by means of the input means 27. The discharge rate of the pump is determined using the quantity discharged and the time over which the pump was operated. The time To over which the relay 29 is operated, which corresponds to the operating time of the pump, is then operated using that discharge rate and the quantity of the replenishing solution required for supply. The relay 29 is energized in accordance with the obtained operating time To. Since the motor 48 constituting the replenishing device 28 is connected to the power source via the relay 29, the motor 48 becomes connected to the power source when the relay 29 is energized, and the output shaft of the motor 46 starts to rotate. This causes the bellows type pump 44 to discharge the replenishing solution, and the replenishing solution is supplied to the developing tank 20.

The quantity of the replenishing solution discharged by the pump when it is operated in a certain period of time is measured with measuring cylinder and is input from the input means 27 connected to the input port 64.

The discharge rate of the pump, which is calculated using the quantity of the solution actually discharged by the pump and the time over which the pump was operated, is stored in the PROM 67 by means of the PROM writer 71.

Figure 8:
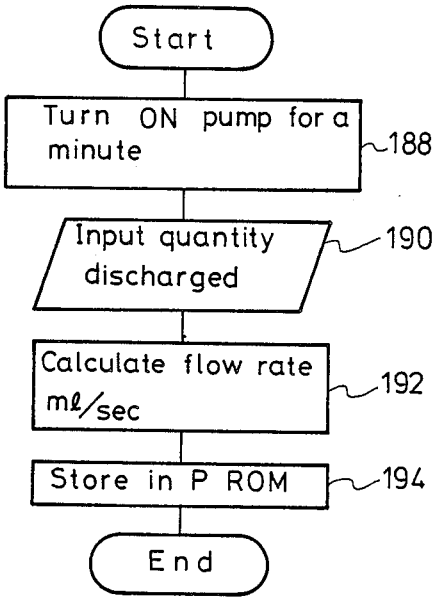
FIGS. 8A and 8B are flowcharts of the pump control routine employed in the second embodiment of the invention.
Figure 8:
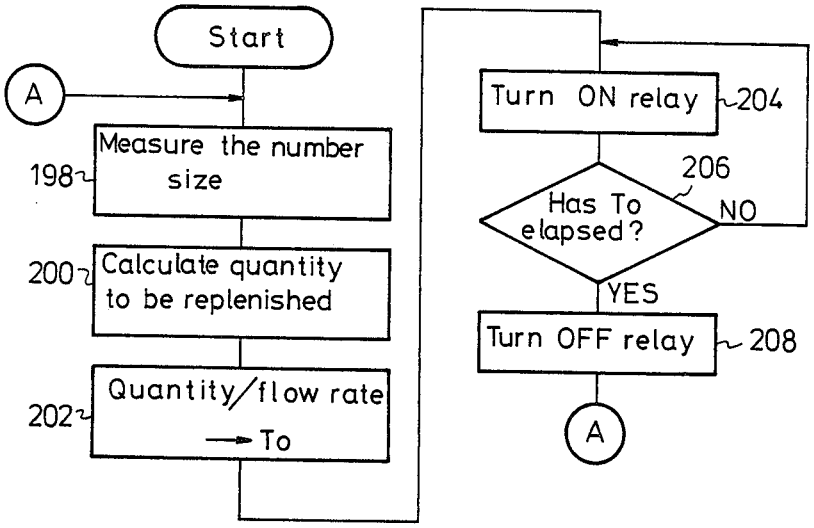

FIG. 8 are flowcharts of the pump control routine of this embodiment.

In Step 188, the pump is driven for a minute so as to discharge the solution, and its quantity is measured with the measuring cylinder. The result is then input in Step 190 by means of the input means 27. In Step 192, the quantity of flow of the pump per unit time (unit flow) is operated using the quantity discharged which has been input, and in Step 194 the operation result is stored in the PROM 67 by means of the PROM writer 71.

Next, the routine of switching on and off the relay 29 according to the operating time of the pump 44 will be described. The CPU 62 calculates the quantity of the solution required for replenishment in Step 200 using the number of films and the size thereof which have been determined in Step 198 from the sensor output. The CPU 62 then calculates the operating time To of the relay 29 which corresponds to that of the pump 44 utilizing that quantity of solution required and the flow rate which has been input, in Step 202. The relay 29 is switched on in Step 204 so as to drive the pump 44. The solution is thereby discharged to the developing tank. In Step 206, the CPU judges whether the operating time has elapsed or not. If the result is no, the program returns to Step 204, and the pump 44 continues to operate. If the answer is yes, the relay 29 is switched off in Step 208, and the pump is stopped to stop the replenishment. The routine program then returns to Step 198, and si then repeated starting at Step 198 until the power source of the control section 37 is turned off.

As has been described above, the replenishing device of this embodiment is used to supply the replenishing solution to the developer. It is to be understood, however, the present invention is also applicable to replenishment of the fixing solution.

Also, it is to be noted that the method of supplying replenishing solution of the present invention can be applied for the processing of various types of films. In particular, the method can be effectively used for the processing of high contrast types of films as those described in the specifications of U.S. Pat. Nos. 4,224,401; 4,168,977; 4,166,742; 4,311,781; 4,272,606; 4,241,164; 4,211,857; and 4,243,739, where hydrozine derivatives are contained in the light-sensitive layers.

Furthermore, the replenishing solutions used for the present invention may be those as discribed in U.S. Ser. No. 919,077, and the developing solutions used for the present invention may be those as described in Kohkai-Gihoh No. 87-1068 published Jan. 20, 1987.

Moreover, the method of supplying replenishing solution of the present invention can be applied for the processing of a PS plate (presensitized alminum offset printing plate).

The third embodiment is described below.

In this embodiment the relationship between the sensor 18 and the control section 32 is described in detail.

Figure 9:
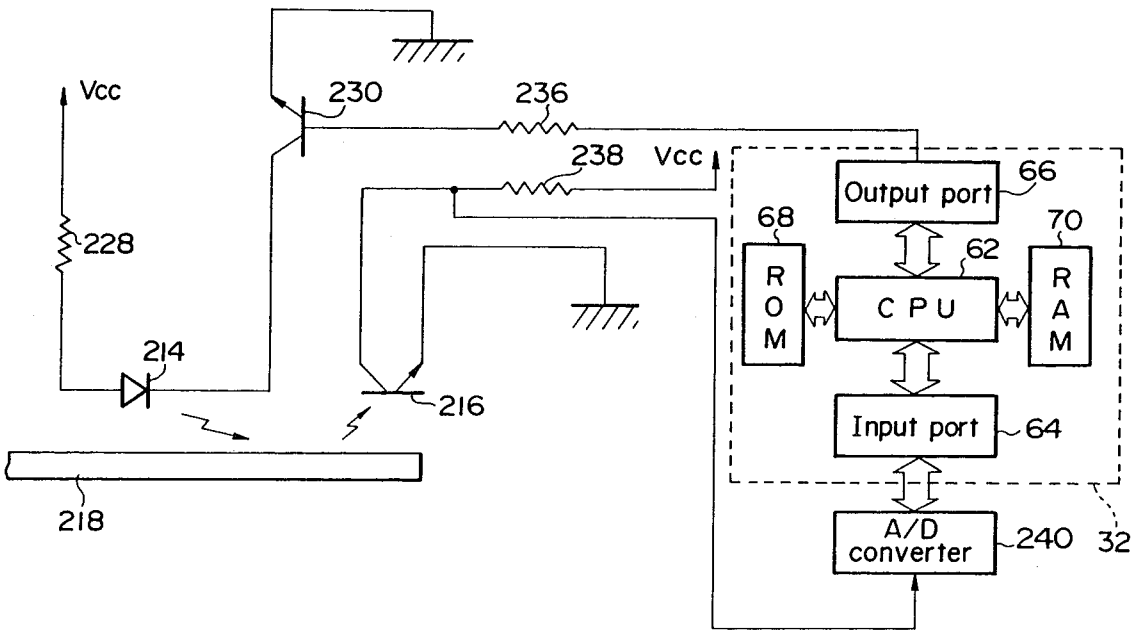
FIG. 9 is a circuit diagram which shows the input-/output relationship between light emitting and light detecting elements and a CPU and which is employed in the third embodiment.

As shown in FIG. 9, the anode of a light emitting element 214 is connected to a power source Vcc through a resistor 228. The cathode of the light emitting element 214 is connected to the collector of a transistor 230. The emittor of the transistor 230 is grounded, and the base thereof is connected to the output port 64 of the control section 32 through a resistor 236. The control section 32 controls the light emitting element 214 to cause it to emit light, intermittently. That is to say, the pulse signal having a predetermined width (for example, 1 msec) is preliminarily stored in the ROM 68, and it is supplied to the base of the transistor 230 in a predetermined cycle, so that the light emitting element 214 is driven intermittently.

Also, the emitter of a light detecting element 216 is grounded and the collector thereof is connected to the power source Vcc through a resistor 238. Further, the collector is connected with an A/D converter 240. The A/D converter 240 converts an analog signal output from the light detecting element 216 to a digital signal and it outputs the digital signal to the CPU 62 through the input port 32. At this time the CPU 62 detects the exposed film 218 as a detecting means.

The operations of the sensor 18 and the control section 32 are described below with reference to FIG. 10.

When the power source of the automatic developing machine 10 is switched on, the light emitting element 214 begins to emit light in Step 248. That is to say, the light emitting element 214 is turned ON. In Step 250, the output value output from the A/D converter 240 is input to the control section 32. In Step 252, a judgement is made as to whether or not the output value output from the A/D converter 240 is a given value L1 or more. In case that the exposed film has not been inserted yet in the machine 10, that is, the output value of the A/D converter 240 is less than the given value L1, the flag f is set to zero in Step 253, and in Step 254 a judgement is made as to whether or not the emitting time of the light emitting element 214 (i.e., the time over which the element 214 is on) is 1 msec.

In Step 254, if the answer is no, the program returns to Step 248 and the element 214 continues to emit light. In Step 254, when the answer is yes, i.e., 1 msec has elapsed, the program proceeds to Step 256 in which the element 214 is turned Off, i.e., the element 214 stops to emit light. In Step 258, a judgement is made as to whether on not the time over which the element 214 is Off exceeds 1 msec. If the answer is no, the program returns to Step 256 in which the element 214 is kept in Off situation. In Step 258, if the answer is yes, the program returns to Step 248 and the element 214 is turned ON again to begin to emit light. Unless the exposed film 218 has been inserted in the machine 10, light emitted from the element 214 is not reflected by the film 218, that is, it is not detected, or received, by the light detecting element 216, and therefore the output value of the A/D converter 240 is not more than the given value L1. Accordingly, the above stated Steps are repeated, and the ON and OFF drive of the light emitting element 214 are repeated each 1 sec.

When the exposed film 218 is inserted in the machine 10 and the light emitted from the element 214 and reflected by the film 218 is received, or detected, by the light detecting element 216, the output value of the A/D converter 240 becomes the given value L1 or more, and in Step 251 the flag f is set to 1. In Step 260, a judgement is made as to whether or not the time over which the element 214 is kept in ON situation has reached 0.5 msec. If the answer is no, the element 214 continues to emit light, and when the time has reached 0.5 msec, the element 214 is switched OFF in Step 262. In Step 264, a judgement is made as to whether or not the time over which the element 214 is kept in OFF situation has reached 0.5 msec. If the answer is no, the element 214 continues to be in OFF situation. When 0.5 msec have elapsed, the number of time C in which the element is in ON situation for 0.5 msec is subjected to increment.

Figure 10:
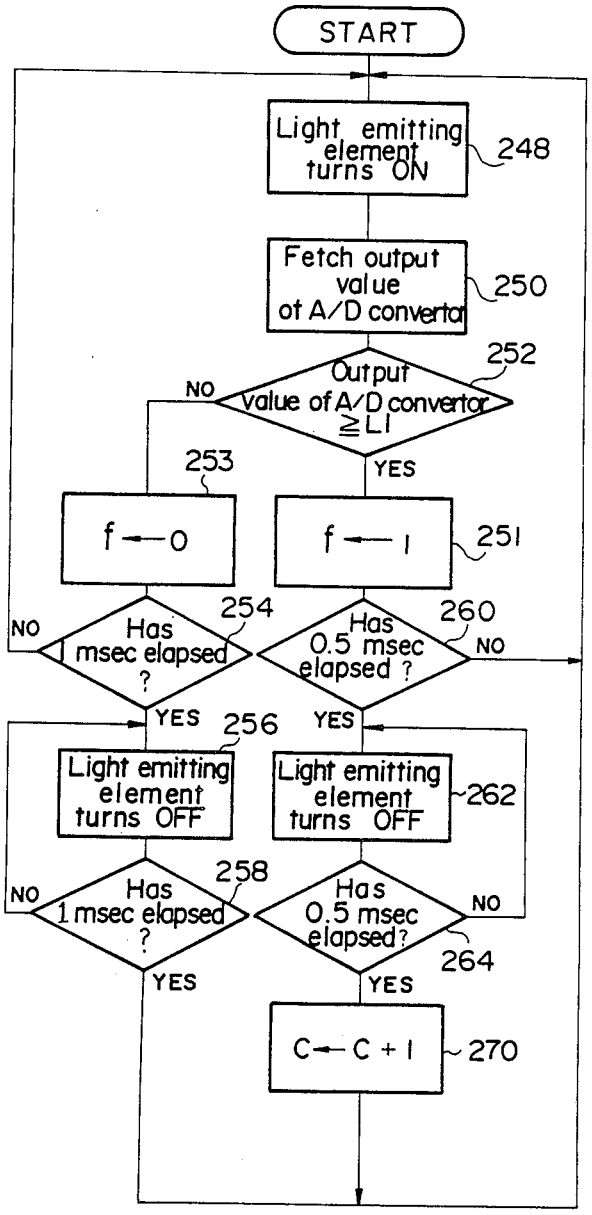
FIGS. 10A and 10B are flow charts of the operation of the circuit diagram of FIG. 9.
Figure 10B:
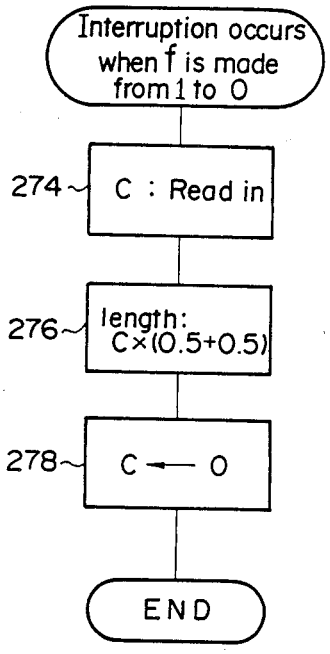

While the exposed film 218 is being detected by the sensor 18, the above control routine is repeated The length of the exposed film 218 is obtained by the number of time C, the time (0.5 msec) over which the element 214 is kept in ON situation, and the time (0.5 msec) over which the element 214 is kept in OFF situaton FIG. 10 (B) shows an interruption routine for obtaining the length of the film 218. This routine is carried out when the flag f is made from 1 to 0. In Step 274, the number of time C is read in, and in Step 276 the length of the film 218 is calculated. After the length is obtained, the number of time C is cleared in Step 278.

Since the sensor 18 is controlled in the above manner by the control section 32, that is, the light emission of the element 214 is conducted, intermitlently, the amount of the light irradiated to the exposed film 218 can largely be decreased, so that the exposed filn 218 is prevented from excess exposure due to the emission of the light emitting element 214 of the sensor 18.

Figure 11:
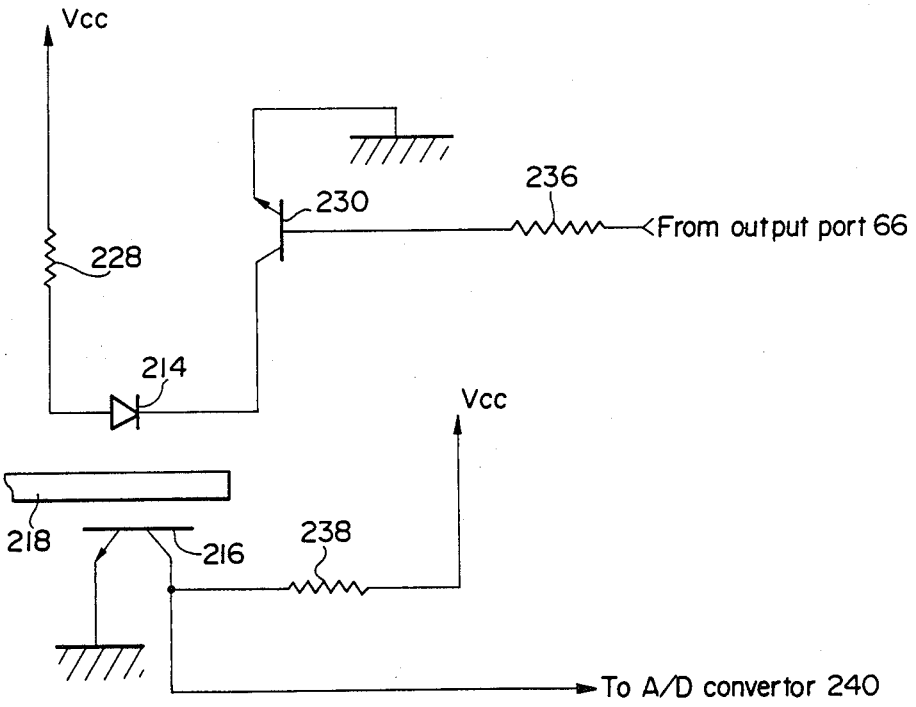
FIG. 11 is a circuit diagram employed in the fourth embodiment.

FIG. 11 shows another embodiment. In this embodiment, the sensor 18 is constituted such that the light emitted by the light emitting element 214 is transmitted through the film 218 to the light detecting element 216. The other construction of this embodiment is the same as that of the embodiment shown in FIG. 9, the description being omitted. The amount of the light irradiated to the exposed film 218 may be reduced by other means, for example, using a filter element.

What is claimed is:

1. A method of supplying replenishing solution in an automatic developing machine which processes exposed film by means of a pump, comprising the steps of:

(a) determining the discharge rate, $Q_O$, of said pump;

(b) determining the total quantity, Q, of replenishing solution to be supplied on the basis of the amount of exposed film to be processed;

(c) determining the operating time, $T_O$, required for said pump to supply the quantity of replenishing solution determined in step (b) using said discharge rate and said total quantity; and (d) continuously operating said pump in said operating time so as to supply the amount of replenishing solution determined in step (b).

2. A method of supplying replenishing solution according to claim 1, wherein said step of determining said discharge rate comprises measuring the quantity of solution discharged by said pump when said pump is operated for a given period of time and determining the discharge rate using the obtained quantity and time.

3. A method of supplying replenishing solution according to claim 1, further including the step of selecting said pump to have a discharge rate such that the time required for the pump to supply the determined quantity of replenishing solution is longer than the time for which the exposed film is processed.

4. A method of supplying replenishing solution according to claim 2, wherein the amount of the exposed film to be processed employed in said step of determining the total quantity of said replenishing solution is determined on the basis of the number of the exposed films and the size thereof.

5. A method of supplying replenishing solution according to claim 4, wherein said step of continuously operating said pump comprises continuously operating said pump since the processing of said exposed film has started.

6. A method of supplying replenishing solution according to claim 5, further comprising the step (e) of stopping said determined pump when the quantity of replenishing solution which has been supplied becomes equal to said total quantity of replenishing solution, so as to stop the replenishement.

7. A method of supplying replenishing solution according to claim 1, wherein said step of determining the total quantity of replenishing solution to be supplied comprises detemining said total quantity in accordance with the area of said exposed film.

8. A method of supplying replenishing solution in an automatic developing machine which processes exposed film by means of a pump, comprising the steps of:

(a) determining the discharge rate, $Q_O$, of said pump;

(b) determining the total quantity, Q, of replenishing solution to be supplied on the basis of the amount of exposed film to be processed;

(c) determining the operating time, $T_O$, required for said pump to supply the quantity of replenishing solution in step (b) using said discharge rate and said total quantity;

(d) continuously operating said pump for said operating time so as to supply the amount of replenishing solution determined in step (b); and (e) stopping the operation of said pump upon confirmation of operation of said pump for said operating time.

9. A method of supplying replenishing solution according to claim 8, wherein said step of determining said discharge rate comprises measuring the quantity of solution discharged by said pump when said pump has been operated for a given period of time and detemining the discharge rate using the obtained quantity and time.

10. A method of supplying replenishing solution according to claim 8, further including the step of selecting said pump to have a discharge rate such that the time required for said pump to supply the determined quantity of replenishing solution is longer than the time for which the exposed film is processed.

11. A method of supplying replenishing solution according to claim 9, wherein the amount of exposed film to be processed employed in said step of determining the total quantity of said replenishing solution is determined on the basis of the number of exposed films and the size thereof.

12. A method of supplying replenishing solution according to claim 11, wherein said step of continuously operating said pump comprises continuously operating said pump since the processing of said exposed film has started.

13. A method of supplying replenishing solution according to claim 8, wherein said step of determining the total quantity of said replenishing solution comprises determining said total quantity of replenishing solution in accordance with the area of said exposed film.

14. A method of supplying replenishing solution in an automatic developing machine which processes exposed film by means of a pump, comprising the steps of:

(a) determining the discharge rate of said pump;

(b) detecting the start of processing of said exposed film;

(c) determining the amount of exposed film to be processed since the processing of said exposed film has started;

(d) determining the total quantity of replenishing solution to be supplied in accordance with said amount of exposed film;

(e) determining the operating time required for said pump to supply the quantity of replenishing solution determined in step (b) using said discharge rate and said total quantity;

(f) continuously operating said pump in said operating time; and (g) stopping the operation of said pump upon confirmation of operation of said pump for said operating time.

15. A method of supplying replenishing solution according to claim 14, wherein said step of determining said discharge rate comprises measuring the quantity of solution discharged by said pump when said pump has been operated for a given period of time and determining the discharge rate using the obtained quantity and time.

16. A method of supplying replenishing solution according to claim 15, wherein the amount of exposed film to be processed employed in said step of determining the total quantity of said replenishing solution is determined on the basis of the number of exposed films and the size thereof.

17. A method of supplying replenishing solution according to claim 16, wherein said step of continuously operating said pump comprises continuously operating said pump since the processing of said exposed film has started.

18. A method for supplying replenishing solution according to claim 14, wherein said step of determining the total quantity of said replenishing solution comprises determining said total quantity on the basis of the area of said exposed film.

* * * * *